US010657876B2

(12) United States Patent
Zhao et al.

(10) Patent No.: US 10,657,876 B2
(45) Date of Patent: May 19, 2020

(54) GATE DRIVING CIRCUIT FOR PROVIDING PRESENT VOLTAGE BY TRANSMISSION PATH IN NON-OPERATIVE STATE AND DISPLAY DEVICE

(71) Applicants: BEIJING BOE OPTOELECTRONICS TECHNOLOGY CO., LTD., Beijing (CN); BOE TECHNOLOGY GROUP CO., LTD., Beijing (CN)

(72) Inventors: Detao Zhao, Beijing (CN); Pengcheng Tian, Beijing (CN); Shuai Xu, Beijing (CN); Xin Li, Beijing (CN)

(73) Assignees: BEIJING BOE OPTOELECTRONICS TECHNOLOGY CO., LTD., Beijing (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/105,085

(22) Filed: Aug. 20, 2018

(65) Prior Publication Data

US 2019/0266936 A1 Aug. 29, 2019

(30) Foreign Application Priority Data

Feb. 26, 2018 (CN) ..... 2018 1 0159929

(51) Int. Cl.
*G09G 3/20* (2006.01)

(52) U.S. Cl.
CPC ... *G09G 3/2092* (2013.01); *G09G 2300/0426* (2013.01); *G09G 2310/0267* (2013.01)

(58) Field of Classification Search
CPC ..... G09G 3/2092; G09G 2300/0426; G09G 2310/0267
See application file for complete search history.

(56) References Cited

U.S. PATENT DOCUMENTS

2007/0296681 A1* 12/2007 Kim ..... G11C 19/184 345/100
2008/0088555 A1* 4/2008 Shin ..... G09G 3/3677 345/87
2015/0179128 A1* 6/2015 Huang ..... G09G 5/00 315/169.1
2015/0348507 A1* 12/2015 Zhang ..... G09G 3/3677 345/213
2017/0069283 A1* 3/2017 You ..... G11C 19/184

* cited by examiner

*Primary Examiner* — Chun-Nan Lin
(74) *Attorney, Agent, or Firm* — Brooks Kushman P.C.

(57) ABSTRACT

A gate driving circuit provided in embodiments of the present disclosure includes: N-stage gate driving units, the gate driving unit at each stage of the N-stage gate driving units having a first voltage terminal and a clock signal terminal, and a first transmission path being formed between the first voltage terminal and the clock signal terminal, wherein at each stage, the first transmission path of the gate driving unit is conductive when the gate driving unit is in a non-operative state; and a first voltage line connected to the first voltage terminal of the gate driving unit at each stage. A preset voltage received by a clock signal terminal of a gate driving unit that is in a non-operative state is transmitted to the first voltage line through the first transmission path of the gate driving unit.

17 Claims, 7 Drawing Sheets

GATE DRIVING CIRCUIT FOR PROVIDING PRESENT VOLTAGE BY TRANSMISSION PATH IN NON-OPERATIVE STATE AND DISPLAY DEVICE

CROSS-REFERENCE TO RELATED APPLICATION

This application claims priority to Chinese Patent Application No. 201810159929.7 filed on Feb. 26, 2018, which is incorporated herein by reference in its entirety.

TECHNICAL FIELD

Embodiments of the present disclosure relate to the field of display technology, in particular to a gate driving circuit and a display device comprising the same.

BACKGROUND

A GOA (Gate Driver on Array) circuit is a circuit in which a gate driver is directly made on an array substrate. The use of the GOA circuit may lead to reduced cost and power consumption of products, and also realize frame narrowing of the display device as well as a more aesthetic appearance. However, inventors found that there are at least the following issues in related art, namely it is difficult to meet the requirements of the design of cutting into an irregular-shaped screen such as a cut angle in a pad area of the display device since signal lines in the pad area are densely arranged.

SUMMARY

In a first aspect of the present disclosure, there is provided a gate driving circuit that includes: N-stage gate driving units, the gate driving unit at each stage of the N-stage gate driving units having a first voltage terminal and a clock signal terminal, and a first transmission path being formed between the first voltage terminal and the clock signal terminal, wherein N is an integer greater than 1, and at each stage, the first transmission path of the gate driving unit is conductive when the gate driving unit is in a non-operative state; and a first voltage line connected to the first voltage terminal of the gate driving unit at each stage. A preset voltage received by a clock signal terminal of a gate driving unit that is in a non-operative state is transmitted to the first voltage line through the first transmission path of the gate driving unit, so that the first voltage line provides the preset voltage for the first voltage terminal of the gate driving unit at each stage.

According to one embodiment of the present disclosure, the gate driving unit at each stage of the N-stage gate driving units further has a second voltage terminal, and a second transmission path is formed between the first voltage terminal and the second voltage terminal. At each stage, the second transmission path of the gate driving unit is conductive when the gate driving unit is in a non-operative state. The gate driving circuit further includes a second voltage line connected to the second voltage terminal of the gate driving unit at each stage. The preset voltage of the first voltage line is transmitted to the second voltage line through the second transmission path of the gate driving unit that is in the non-operative state, so that the second voltage line provides the preset voltage for the second voltage terminal of the gate driving unit at each stage.

According to one embodiment of the present disclosure, the gate driving unit at each stage includes an output unit and a first pull-down unit. In the gate driving unit at each stage, the first transmission path is formed by the output unit and the first pull-down unit, the output unit is connected to the clock signal terminal, an input unit of the gate driving unit and an output terminal of the gate driving unit, and the first pull-down unit is connected to the first voltage terminal and the output terminal of the gate driving unit.

According to one embodiment of the present disclosure, the gate driving unit at each stage includes a reset unit and a second pull-down unit. In the gate driving unit at each stage, the second transmission path is formed by the reset unit and the second pull-down unit, the reset unit is connected to the second voltage terminal, the output unit, the input unit of the gate driving unit and the second pull-down unit, and the second pull-down unit is connected to the first voltage terminal and the reset unit.

According to one embodiment of the present disclosure, in the gate driving unit at each stage, the first pull-down unit and the second pull-down unit are also connected to a control unit of the gate driving unit, and the first pull-down unit and the second pull-down unit are turned on under the control of the control unit so that the first transmission path and the second transmission path are conductive.

According to one embodiment of the present disclosure, in the gate driving unit at each stage, the output unit includes: a first transistor having a gate electrode connected to the input unit of the gate driving unit, a first electrode connected to the clock signal terminal, and a second electrode connected to the output terminal of the gate driving unit; and a first capacitor having one end connected to the gate electrode of the first transistor and another end connected to the second electrode of the first transistor.

According to one embodiment of the present disclosure, in the gate driving unit at each stage, the first pull-down unit includes: a second transistor having a gate electrode connected to the control unit, a first electrode connected to the output terminal of the gate driving unit, and a second electrode connected to the first voltage terminal.

According to one embodiment of the present disclosure, in the gate driving unit at each stage, the second pull-down unit includes: a third transistor having a gate electrode connected to the control unit, a first electrode connected to the reset unit, and a second electrode connected to the first voltage terminal.

According to one embodiment of the present disclosure, in the gate driving unit at each stage, the reset unit includes: a fourth transistor having a gate electrode connected to a reset terminal of the gate driving unit, a first electrode connected to the input unit, the output unit and the second pull-down unit, and a second electrode connected to the second voltage terminal.

According to one embodiment of the present disclosure, in the gate driving unit at each stage, the control unit includes: a fifth transistor having a gate electrode connected to a first electrode of the fifth transistor and further to a third voltage terminal; a sixth transistor having a first electrode connected to a second electrode of the fifth transistor, a second electrode connected to the first voltage terminal, and a gate electrode connected to the input unit and the output unit; a seventh transistor having a gate electrode connected to the second electrode of the fifth transistor and a first electrode connected to the third voltage terminal; and an eighth transistor having a first electrode connected to a second electrode of the seventh transistor and further to the first pull-down unit and the second pull-down unit, a second electrode connected to the first voltage terminal, and a gate electrode connected to the input unit and the output unit.

According to one embodiment of the present disclosure, the preset voltage is a low voltage signal when the first transistor is an N-type transistor. The present voltage is a high voltage signal when the first transistor is a P-type transistor.

According to one embodiment of the present disclosure, the low voltage signal is set to −12 V.

According to one embodiment of the present disclosure, the high voltage signal is set to +12 V.

According to one embodiment of the present disclosure, at each stage, the gate driving unit further includes a third pull-down unit connected to the first voltage terminal and the output terminal.

According to one embodiment of the present disclosure, in the gate driving unit at each stage, the third pull-down unit includes a tenth transistor having a gate electrode connected to a control signal terminal, a first electrode connected to the output terminal of the gate driving unit, and a second electrode connected to the first voltage terminal.

According to one embodiment of the present disclosure, the first to tenth transistors are all thin film transistors.

According to one embodiment of the present disclosure, the gate driving circuit is a GOA circuit.

In a second aspect of the present disclosure, there is further provided a display device that includes the gate driving circuit as described above.

According to one embodiment of the present disclosure, the display device further includes a driving chip that is configured to provide a driving signal for the gate driving circuit, and the first voltage line is not connected to the driving chip.

The additional aspects and advantages of the embodiments of the present disclosure will be set forth in part in the description which follows, and another part thereof will become apparent from the following description or from the practice of the present disclosure.

BRIEF DESCRIPTION OF THE DRAWINGS

The above and/or additional aspects and advantages of the present disclosure will become apparent and readily understood from the following description of the embodiments made in conjunction with the accompanying drawings, in which.

DETAILED DESCRIPTION

Figure 1:
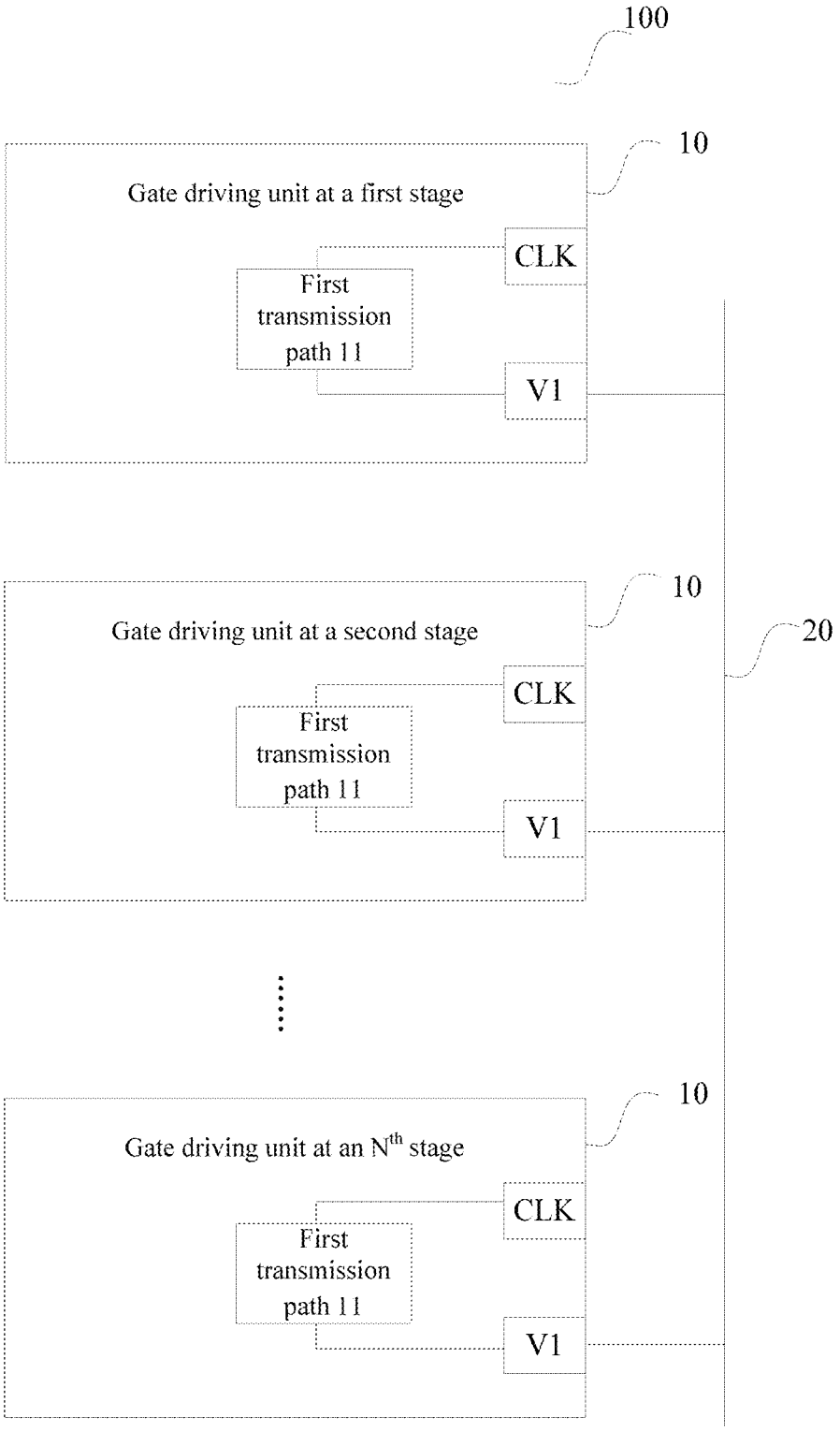
FIG. 1 is a block diagram showing a gate driving circuit according to an embodiment of the present disclosure.

The embodiments of the present disclosure will be described in detail below, and examples of the embodiments are illustrated in the drawings, in which the same or similar reference numerals are used to refer to the same or similar elements or elements having the same or similar functions. The embodiments described below with reference to the drawings are illustrative, and intended to explain the present disclosure rather than to be construed as limitations thereof.

For ease of understanding, a pad area of a display device is first briefly described.

The pad area of the display device is a crimping area on which signal lines of an array substrate are crimped to leads of an external driving chip, for example, Chip-On-Film, after processes of cutting and grinding. Typically, the pad area is provided with only signal lines, without components such as pixel electrodes and thin film transistors (TFTs). The pad area is located on one side or two adjacent sides of four sides of the array substrate of the display device. In the pad area, there may be no insulating layer (a gate insulating layer, a passivation layer or the like) covering the signal lines such that the leads of the external driving chip are electrically connected to the signal lines of the array substrate.

A gate driving circuit and a display device comprising the same according to embodiments of the present disclosure will be described below with reference to the drawings.

FIG. 1 is a block diagram showing a gate driving circuit according to an embodiment of the present disclosure. As shown in FIG. 1, the gate driving circuit 100 includes N-stage gate driving units 10 and a first voltage line 20.

The gate driving unit 10 at each stage of the N-stage gate driving units 10 has a first voltage terminal V1 and a clock signal terminal CLK, between which a first transmission path 11 is formed. At each stage, when the gate driving unit 10 of the stage is in a non-operative state, a clock signal received by the clock signal terminal CLK of the gate driving unit 10 of the stage is at a preset voltage, and the first transmission path 11 of the gate driving unit 10 of the stage is conductive. Here, N is an integer greater than 1. The first voltage line 20 may be used to provide the preset voltage and is connected to the first voltage terminal V1 of the gate driving unit 10 at each stage. The preset voltage received by the clock signal terminal CLK of the gate driving unit 10 that is in the non-operative state is transmitted to the first voltage line 20 through the first transmission path 11 of the gate driving unit 10, so that the first voltage line 20 provides the preset voltage for the first voltage terminal V1 of the gate driving unit 10 at each stage.

According to an embodiment of the present disclosure, the preset voltage may be a low voltage signal, such as −12 V, or may be a high voltage signal, such as +12 V.

It can be understood that, the clock signal terminal is used to receive a clock signal CLK which can periodically alternate between a high voltage and a low voltage. When the preset voltage is a low voltage signal, the clock signal terminal of the gate driving unit 10 in the non-operative state receives the low voltage signal. In addition, when the preset voltage is a high voltage signal, the clock signal terminal of the gate driving unit 10 in the non-operative state receives the high voltage signal.

It should be noted that "high voltage" and "low voltage" herein refer to two logic states represented by potential ranges, respectively. For example, the low voltage may refer to a potential of −12 V, and the high voltage may refer to a potential of +12 V. A specific potential range may be set as needed in a particular application, and is not limited to those set forth in this embodiment of the present disclosure.

Specifically, the N-stage gate driving units 10 are connected in cascade, and are not operated simultaneously. For example, the N-stage gate driving units 10 may operate in sequence. Specifically, when a gate driving unit 10 at any stage is in an operating state, a gate driving unit 10 in a non-operative state has internal conductivity for a preset voltage received by the corresponding clock signal terminal. In this way, the preset voltage can be transmitted to the first voltage line 20 through the first transmission path 11 of the gate driving unit 10 in the non-operative state, and the first voltage line 20 can provide the preset voltage for the first voltage terminal V1 of the gate driving unit 10 at any stage to ensure normal operation of the gate drive unit 10 at any stage.

For example, the following description may be made based on a case that in the N-stage gate driving units 10, the gate driving unit at a first stage is in the non-operative state and the gate driving unit at a second stage is in the operating state. Assuming that the gate driving unit in the non-operative state has good conductivity for a low voltage, when the clock signal received by the clock signal terminal of the gate driving unit at the first stage is at the low voltage, the gate driving unit at the first stage has good conductivity for the low voltage received by the clock signal terminal of the gate driving unit at the first stage, and the low voltage is transmitted to the first voltage line 20 through the first transmission path 11 of the gate driving unit at the first stage. Thus, the first voltage line 20 can provide the low voltage for the gate driving unit at the second stage, thereby ensuring normal operation of the gate drive unit at the second stage.

Figure 2:
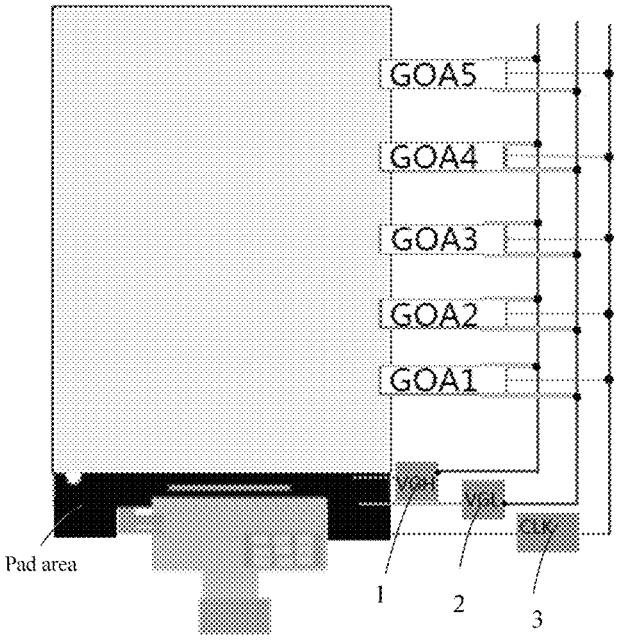
FIG. 2 is a schematic view showing a structure of a gate driving circuit according to the related art.
Figure 3:
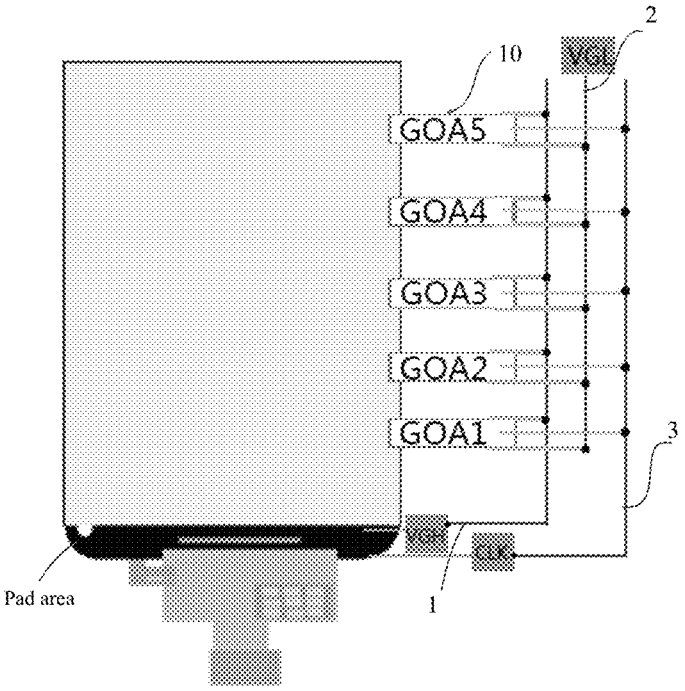
FIG. 3 is a schematic view showing a structure of a gate driving circuit according to one embodiment of the present disclosure.

It should be noted that, as shown in FIG. 2 and FIG. 3, an operation signal of the gate driving circuit 100 may include a VGH signal, that is, a high voltage signal (which is responsible for turning on transistors), a VGL signal, that is, a low voltage signal (which is responsible for turning off transistors), a CLK signal, that is, a clock signal (which is responsible for controlling timing output of the gate driving circuit), etc. In the related art, as shown in FIG. 2, in the pad area of the display device, it is necessary to arrange a high voltage signal line 1 for providing a high voltage signal, a low voltage signal line 2 for providing a low voltage signal, and a clock signal line 3 for transmitting a clock signal. However, in the embodiment of the present disclosure, as shown in FIG. 3, the low voltage is provided by the low voltage of the clock signal, and no external low voltage signal line is needed. Therefore, in the pad area of this display device, the low voltage signal line can be removed, and only the high voltage signal line 1 and the clock signal line 3 are arranged.

Therefore, in the case of ensuring the normal operation of the gate driving circuit, a voltage self-set-to-low function of the gate driving circuit is realized by the internal conductivity of the gate driving circuit for the low voltage (−12 V) in the clock signal. As a result, the number of signal lines in the pad area is reduced (related lines such as the VGL signal lines are removed), and a larger space available for cutting is provided for the cut irregular-shaped screen.

Similarly, assuming that the gate driving unit in the non-operative state has good conductivity for a high voltage, when the clock signal received by the clock signal terminal of the gate driving unit at the first stage is at the high voltage, the gate driving unit at the first stage has good conductivity for the high voltage received by the clock signal terminal of the gate driving unit at the first stage, and the high voltage is transmitted to the first voltage line 20 through the first transmission path 11 of the gate driving unit at the first stage. Thus, the first voltage line 20 can provide the high voltage for the gate driving unit at the second stage, thereby ensuring normal operation of the gate driving unit at the second stage.

Therefore, in the case of ensuring the normal operation of the gate driving circuit, a voltage self-set-to-high function of the gate driving circuit is realized by the internal conductivity of the gate driving circuit for the high voltage (+12 V) in the clock signal. As a result, the number of signal lines in the pad area is reduced (related lines such as the VGH signal lines are removed), and a larger space available for cutting is provided for the cut irregular-shaped screen.

According to one embodiment of the present disclosure, the gate driving circuit may be a GOA circuit.

Figure 4:
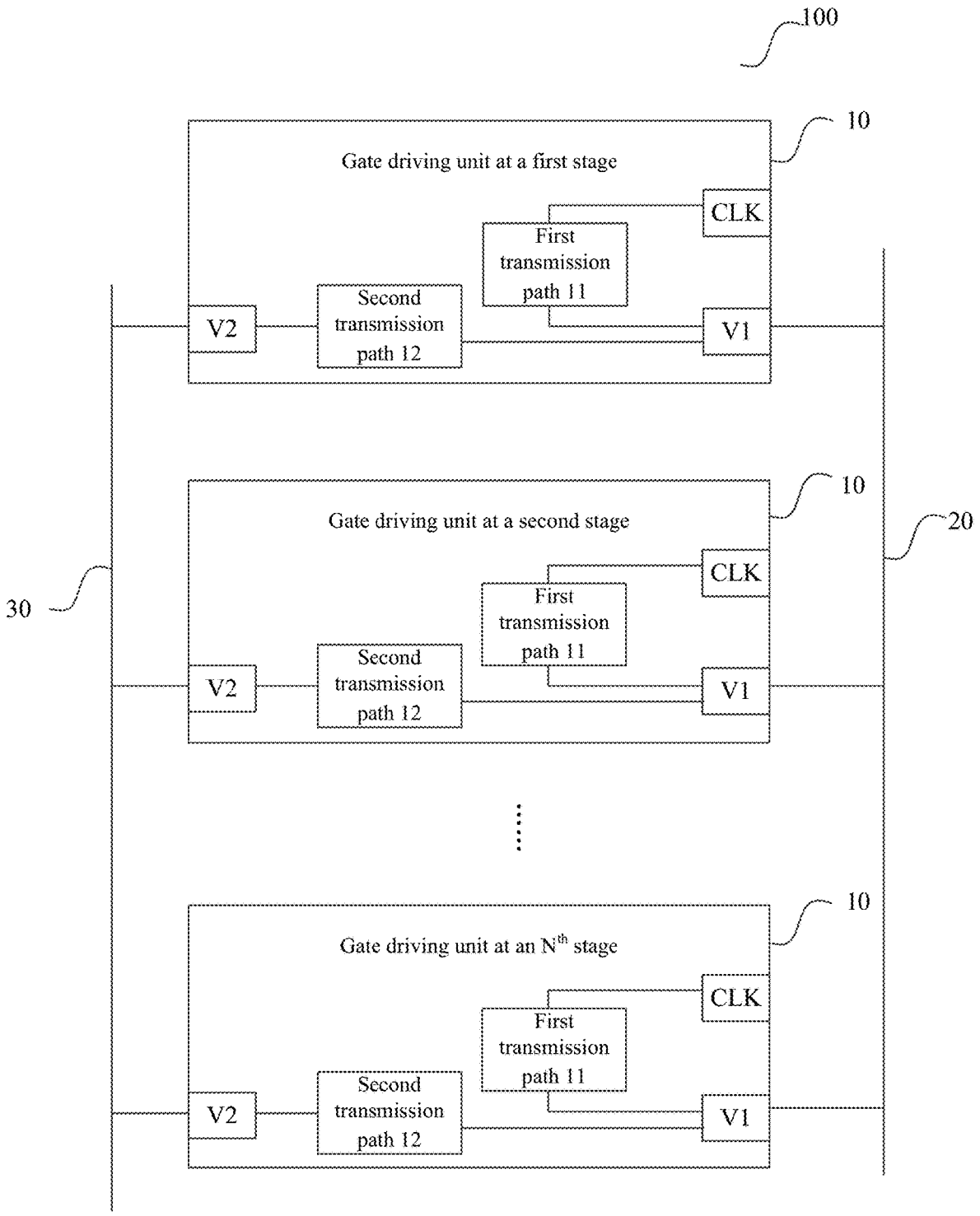
FIG. 4 is a block diagram showing a gate driving circuit according to one embodiment of the present disclosure.

Further, according to an embodiment of the present disclosure, as shown in FIG. 4, the gate driving unit 10 at each stage of the N-stage gate driving units 10 further has a second voltage terminal V2, and a second transmission path 12 is formed between the first voltage terminal V1 and the second voltage terminal V2. At each stage, the second transmission path 12 of the gate driving unit 10 is conductive when the gate driving unit is in a non-operative state. The gate driving circuit 100 further includes a second voltage line 30, which may also provide the preset voltage and which is connected to the second voltage terminal V2 of the gate driving unit 10 at each stage. The preset voltage of the first voltage line 20 is transmitted to the second voltage line 30 through the second transmission path 12 of the gate driving unit 10 that is in the non-operative state, so that the second voltage line 30 provides the preset voltage for the second voltage terminal V2 of the gate driving unit 10 at each stage.

That is to say, the gate driving circuit can also provide the preset voltage for the gate driving unit 10 at each stage through the second voltage line 30. When a gate driving unit 10 at any stage is in an operating state, a gate driving unit 10 in a non-operative state has internal conductivity for a preset voltage received by the corresponding clock signal terminal. In this way, the preset voltage can be transmitted to the first voltage line 20 through the first transmission path 11 of the gate driving unit 10 in the non-operative state, and the first voltage line 20 can provide the preset voltage for the first voltage terminal V1 of the gate driving unit 10 at any stage. At the same time, the preset voltage of the first voltage line 20 can also be transmitted to the second voltage line 30 through the second transmission path 12 of the gate driving unit 10 in the non-operative state, and the second voltage line 30 can provide the preset voltage for the second voltage terminal V2 of the gate driving unit 10 at any stage, thereby ensuring the normal operation of the display device.

The structure and operating principle of the gate driving circuit of the present disclosure will be described in detail below in combination with the embodiment of FIG. 5.

Figure 5:
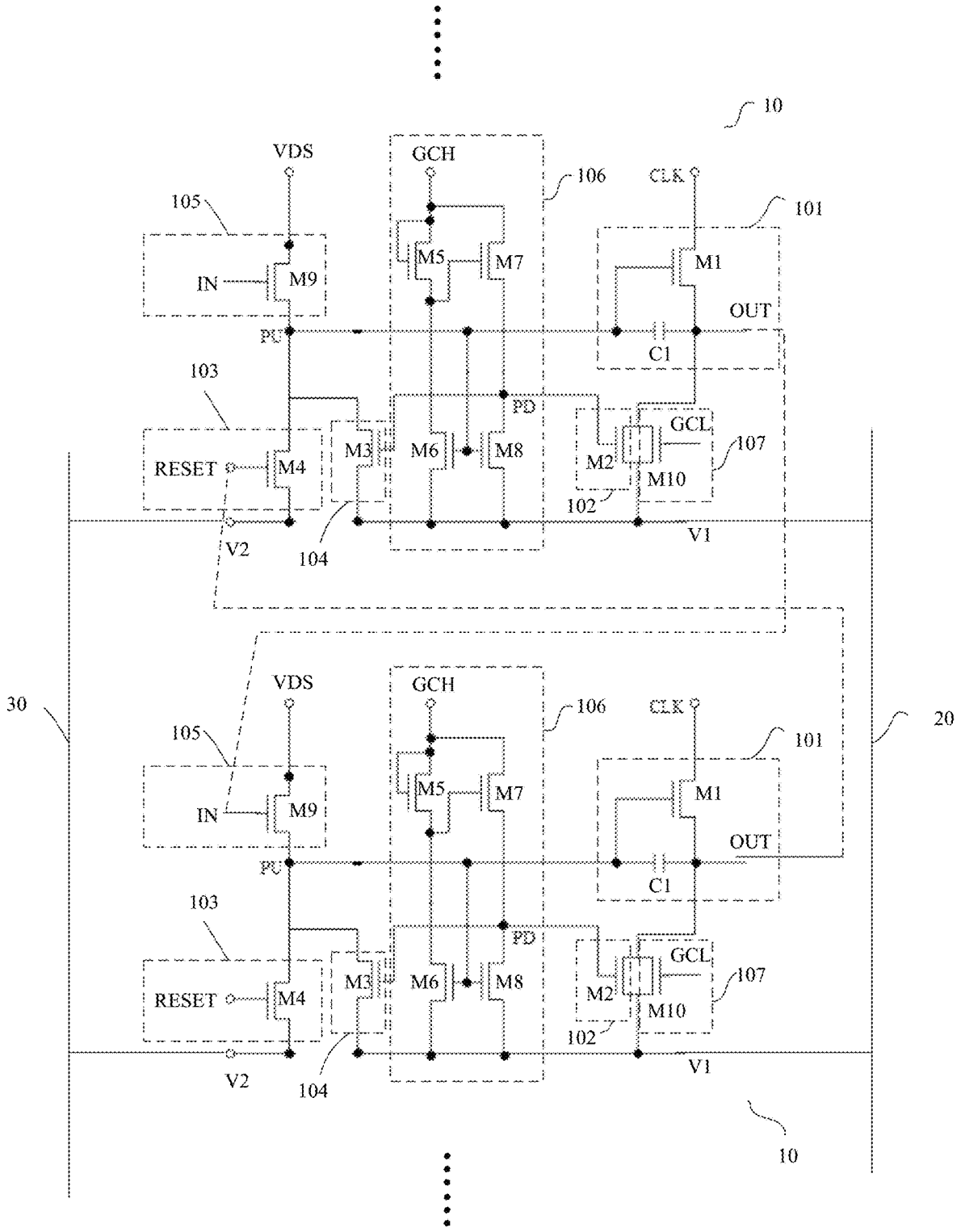
FIG. 5 is a circuit schematic diagram of a gate driving circuit according to one embodiment of the present disclosure.

According to an embodiment of the present disclosure, as shown in FIG. 5, the gate driving unit 10 includes an output unit 101 and a first pull-down unit 102. In the gate driving unit at each stage, the first transmission path 11 is formed by the output unit 101 and the first pull-down unit 102, the output unit 101 is connected to the clock signal terminal CLK, the input unit 105 of the gate driving unit 10 and an output terminal OUT of the gate driving unit 10, and the first pull-down unit 102 is connected to the first voltage terminal V1 and the output terminal OUT of the gate driving unit 10.

Further, the gate driving unit 10 includes a reset unit 103 and a second pull-down unit 104. In the gate driving unit at each stage, the second transmission path 12 is formed by the reset unit 103 and the second pull-down unit 104, the reset unit 103 is connected to the second voltage terminal V2, the output unit 101, the input unit 105 of the gate driving unit 10, and the second pull-down unit 104, and the second pull-down unit 104 is connected to the first voltage terminal V1 and the reset unit 103.

In the gate driving unit at each stage, the first pull-down unit 102 and the second pull-down unit 104 are also connected to a control unit 106 of the gate driving unit, and the first pull-down unit 102 and the second pull-down unit 104 are turned on under the control of the control unit 106 so that the first transmission path 11 and the second transmission path 12 are conductive.

According to an embodiment of the present disclosure, as shown in FIG. 5, the output unit 101 includes a first transistor M1 and a first capacitor C1. In the gate driving unit at each stage, a gate electrode of the first transistor M1 is connected to the input unit 105 of the gate driving unit 10, a first electrode of the first transistor M1 is connected to the clock signal terminal CLK, and a second electrode of the first transistor M1 is connected to the output terminal OUT of the gate driving unit 10. In addition, one end of the first capacitor C1 is connected to the gate electrode of the first transistor M1, and another end of the first capacitor C1 is connected to the second electrode of the first transistor M1.

In the gate driving unit at each stage as shown in FIG. 5, the first pull-down unit 102 includes a second transistor M2. A gate electrode of the second transistor M2 is connected to the control unit 106, a first electrode of the second transistor M2 is connected to the output terminal OUT of the gate driving unit 10, and a second electrode of the second transistor M2 is connected to the first voltage terminal V1.

In the gate driving unit at each stage as shown in FIG. 5, the second pull-down unit 104 includes a third transistor M3. A gate electrode of the third transistor M3 is connected to the control unit 106, a first electrode of the third transistor M3 is connected to the reset unit 103, and a second electrode of the third transistor M3 is connected to the first voltage terminal V1.

In the gate driving unit at each stage as shown in FIG. 5, the reset unit 103 includes a fourth transistor M4. A gate electrode of the fourth transistor M4 is connected to a reset terminal RESET of the gate driving unit 10, a first electrode of the fourth transistor M4 is connected to the input unit 105, the output unit 101 and the second pull-down unit 104, and a second electrode of the fourth transistor M4 is connected to the second voltage terminal V2.

In the gate driving unit at each stage as shown in FIG. 5, the control unit 106 includes a fifth transistor M5, a sixth transistor M6, a seventh transistor M7, and an eighth transistor M8. A gate electrode of the fifth transistor M5 is connected to a first electrode of the fifth transistor M5 and further to a third voltage terminal GCH. A first electrode of the sixth transistor M6 is connected to a second electrode of the fifth transistor M5, a second electrode of the sixth transistor M6 is connected to the first voltage terminal V1, and a gate electrode of the sixth transistor M6 is connected to the input unit 105 and the output unit 101. A gate electrode of the seventh transistor M7 is connected to the second electrode of the fifth transistor M5, and a first electrode of the seventh transistor M7 is connected to the third voltage terminal GCH. A first electrode of the eighth transistor M8 is connected to a second electrode of the seventh transistor M7, and further to the first pull-down unit 102 and the second pull-down unit 104, a second electrode of the eighth transistor M8 is connected to the first voltage terminal V1, and a gate electrode of the eighth transistor M8 is connected to the input unit 105 and the output unit 101.

In addition, in the gate driving unit at each stage as shown in FIG. 5, the input unit 105 includes a ninth transistor M9. A gate electrode of the ninth transistor M9 is connected to an input terminal IN of the gate driving unit 10, a first electrode of the ninth transistor M9 is connected to a fourth voltage terminal VDS, and a second electrode of the ninth transistor M9 is connected to the reset unit 103, the second pull-down unit 104 and the output unit 101. At each stage, the gate driving unit 10 further includes a third pull-down unit 107 that is connected to the first voltage terminal V1 and the output terminal OUT of the gate driving unit 10. In the gate driving unit at each stage, the third pull-down unit 107 includes a tenth transistor M10, and a gate electrode of the tenth transistor M10 is connected to a control signal terminal GCL, a first electrode of the tenth transistor M10 is connected to the output terminal OUT of the gate driving unit 10, and a second electrode of the tenth transistor M10 is connected to the first voltage terminal V1.

According to one embodiment of the present disclosure, the first to tenth transistors M1 to M10 are all thin film transistors (TFTs).

According to one embodiment of the present disclosure, when the first transistor M1 is an N-type transistor such as an N-type TFT, the preset voltage is a low voltage signal. When the first transistor is a P-type transistor such as a P-type TFT, the preset voltage is a high voltage signal. Furthermore, when the first transistor M1 is an N-type transistor such as an N-type TFT, the second transistor M2 to the tenth transistor M10 are all N-type transistors. When the first transistor M1 is a P-type transistor such as a P-type TFT, the second transistor M2 to the tenth transistor M10 are all P-type transistors. Specifically, taking the first transistor M1 being an N-type transistor as an example, as shown in FIG. 5, there is a first node PU between the input unit 105 and the output unit 101. There is a second node PD between the control unit 106 and the first pull-down unit 102 and the second pull-down unit 104. When a gate driving unit is in a non-operative state, the first node PU provides a low voltage, such as −12 V, and the second node PD provides a high voltage, such as +5 V, under the control of the control unit 106. At this time, the first transistor M1 is in an OFF state, and the second transistor M2 and the third transistor M3 are in an ON state.

Due to the performance of the first transistor M1 in the OFF state (the first node PU is at −12 V) to be turned on for a low voltage, the low voltage (i.e., −12 V) in the clock signal CLK is transmitted sequentially through the first transistor M1 and the second transistor M2 to the first voltage line 20, and the low voltage on the first voltage line 20 is then transmitted to the second voltage line 30 through the third transistor M3 and the fourth transistor M4. Therefore, the voltage of −12 V in the clock signal CLK is used as the low voltage source, and the voltage self-set-to-low function of the gate driving circuit is realized by the first transmission path and the second transmission path in the gate driving unit 10. As a result, in the case where the first voltage line 20 and the second voltage line 30 have no external low voltage, the display device still operates normally.

Figure 6:
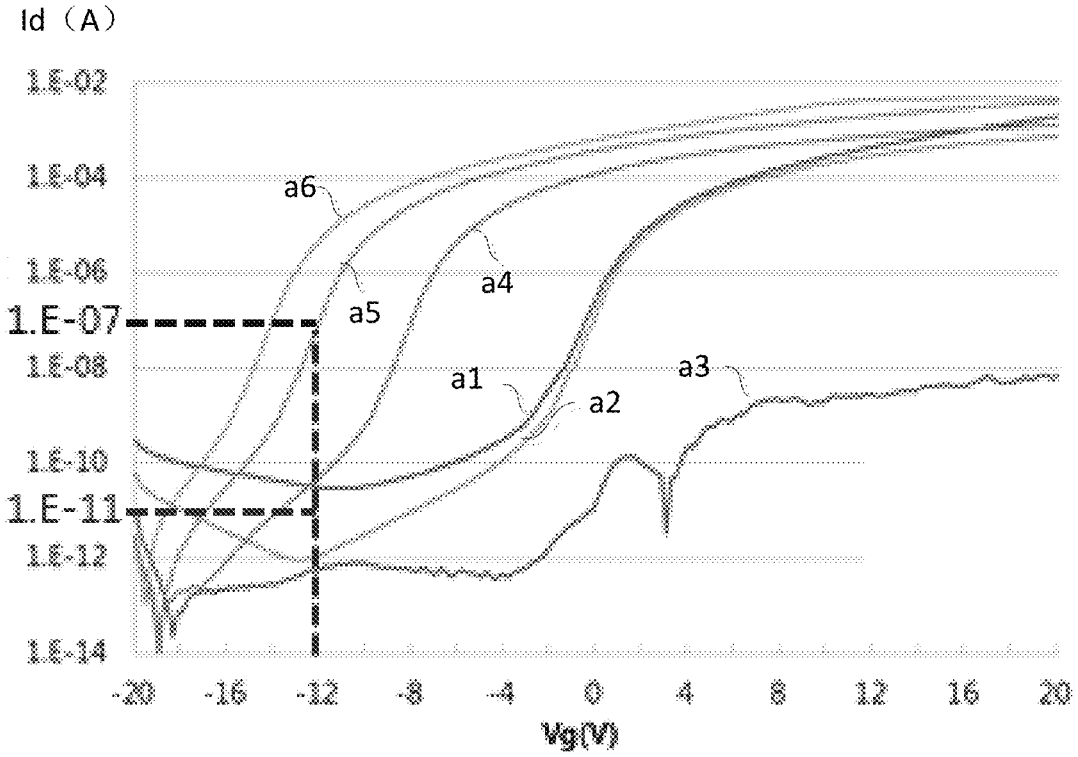
FIG. 6 illustrates characteristic curves of a first transistor in a gate driving circuit according to one embodiment of the present disclosure at different source voltages.

It should be noted that FIG. 6 illustrates characteristic curves of the first transistor M1 at different source voltages, in which an abscissa represents gate voltages Vg of the first transistor M1, an ordinate represents drain currents Id of the first transistor M1, and six curves a1-a6 sequentially correspond to the characteristic curves between the gate voltages and the drain currents Id at six different source voltages, with six voltage values of the source electrode of the first transistor M1 being 15 V, 8 V, 0 V, −8 V, −12 V and −15 V for the six curves a1-a6. As can be seen from FIG. 6, at the same turn-off voltage such as −12 V, the first transistor M1 has different drain currents Id when its source electrode has different voltages. Therefore, the first transistor M1 in the OFF state (the first node PU is at −12 V) has better turn-on performance for the voltage of −12 V in the clock signal CLK.

Figure 7:
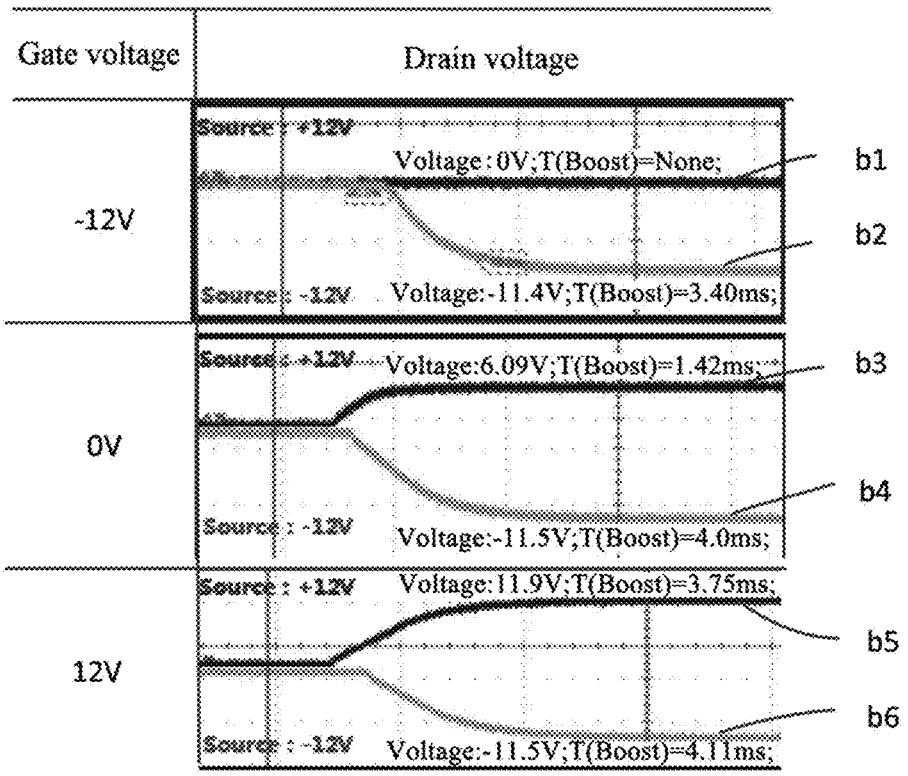
FIG. 7 illustrates verification curves of turn-on performance of a first transistor of a gate driving circuit according to one embodiment of the present disclosure, which is an OFF state, for a voltage of −12 V of the clock signal CLK.

Further, FIG. 7 illustrates verification curves of the turn-on performance of the first transistor M1 in the OFF state (the first node PU is at −12V) for the voltage of −12 V in the clock signal CLK. When the gate electrode of the first transistor M1 is at −12 V, if the source electrode of the first transistor M1 is at +12 V, the drain voltage of the first transistor M1 is substantially 0 V (as shown by curve b1), and if the source electrode of the first transistor M1 is at −12 V, the drain voltage of the first transistor M1 is gradually decreased to near −12 V (as shown by curve b2). When the gate electrode of the first transistor M1 is at 0V, if the source electrode of the first transistor M1 is at +12 V, the drain voltage of the first transistor M1 is slightly increased, for example, to nearly 6 V (as shown by curve b3), and if the source electrode of the first transistor M1 is at −12 V, the drain voltage of the first transistor M1 is gradually decreased to nearly −12 V (as shown by curve b4). When the gate electrode of the first transistor M1 is at +12 V, if the source electrode of the first transistor M1 is at +12 V, the drain voltage of the first transistor M1 can be increased to nearly +12 V (as shown by curve b5), and if the source electrode of transistor M1 is at −12 V, the drain voltage of the first transistor M1 is gradually decreased to nearly −12 V (as shown by curve b6). It can be thus seen that the first transistor M1 in the OFF state (the first node PU is at −12 V) has better turn-on performance for the voltage of −12V in the clock signal CLK, and the first transistor M1 in the OFF state (the first node PU is at −12V) has better turn-off performance for the voltage of +12 V in the clock signal CLK.

Therefore, in the embodiments of the present disclosure, due to the performance of the first transistor M1 in the OFF state (the first node PU is at −12 V) to be turned on for the low voltage, it is possible to achieve the transmission of the low voltage (i.e., −12 V) in the clock signal to the first voltage line 20 sequentially through the first transistor M1 and the second transistor M2, thereby achieving the voltage-self-set-to-low function of the gate driving circuit.

Figure 8:
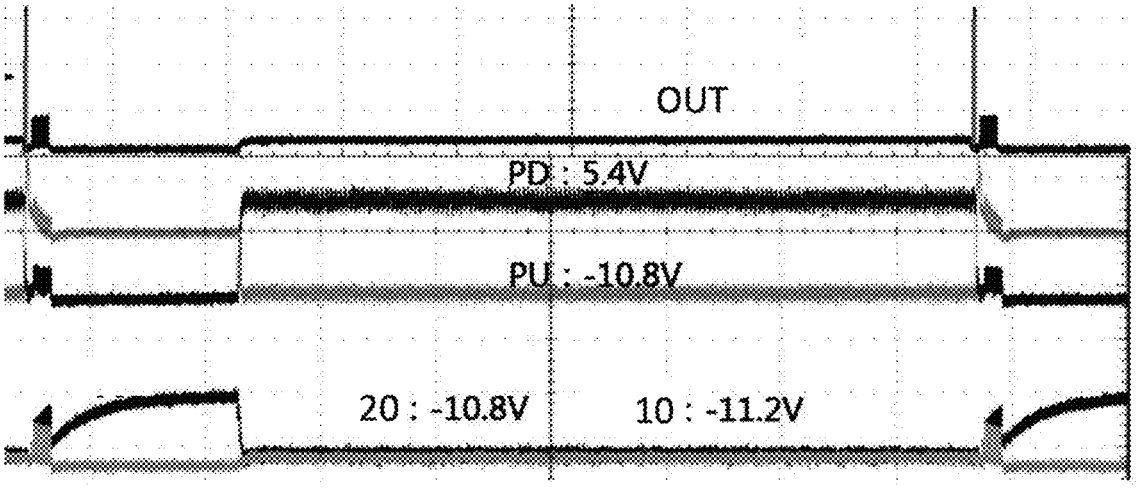
FIG. 8 illustrates operational curves of a gate driving circuit according to one embodiment of the present disclosure.

Specifically, operational curves shown in FIG. 8 can be obtained by sampling using the gate driving circuit of the embodiment of the present disclosure. As can be seen from FIG. 8, when the gate driving unit is in a non-operative state, that is, the output terminal OUT of the gate driving unit does not perform output, the first node PU provides a low voltage such as −12 V, the second node PD provides a high voltage such as +5 V, and the first voltage line 20 and the second voltage line 30 are at low voltages, which indicates that the gate driving circuit of the embodiments of the present disclosure can implement the voltage self-set-to-low function without affecting the normal operation.

It should be noted that the operating principle of the gate driving circuit when the first transistor M1 is a P-type transistor is basically similar to that of the gate driving circuit when the first transistor M1 is an N-type transistor, and the difference therebetween is that when the first transistor M1 is a P-type transistor, the first transistor M1 in the OFF state (the first node PU is at +12 V) has the performance to be turned on for a high voltage. Specifically, the high voltage (i.e., +12 V) in the clock signal CLK is transmitted sequentially through the first transistor M1 and the second transistor M2 to the first voltage line 20, and the high voltage on the first voltage line 20 is then transmitted to the second voltage line 30 through the third transistor M3 and the fourth transistor M4. Therefore, the voltage of +12 V in the clock signal CLK is used as the high voltage source, and the voltage self-set-to-high function of the gate driving circuit is realized by the first transmission path and the second transmission path in the gate driving unit 10. As a result, in the case where the first voltage line 20 and the second voltage line 30 have no external high voltage, the display device still operates normally.

Furthermore, as shown in FIG. 5, a cascade structure of the N-stage gate driving units may be such that the input terminal of the gate driving unit at each stage is connected to the output terminal of the gate driving unit at an immediately preceding stage, and the reset terminal of the gate driving unit at each stage is connected to the output terminal of the gate driving unit at the next stage.

In summary, in the gate driving circuit according to the embodiments of the present disclosure, the preset voltage received by the corresponding clock signal terminal is transmitted to the first voltage line through the first transmission path of the gate driving unit in the non-operative state to allow the first voltage line to provide the preset voltage for the first voltage terminal of the gate driving unit at each stage. Therefore, the gate driving circuit of the embodiments of the present disclosure can realize the voltage-self-set function and effective reduction in the number of the signal lines in the pad area of the display device, such as removal of the signal line for powering the first voltage line in the pad area, reducing the wiring space of the pad area and providing a larger space available for cutting for the cut irregular-shaped screen.

In order to implement the above embodiments, the present disclosure also provides a display device.

Figure 9:
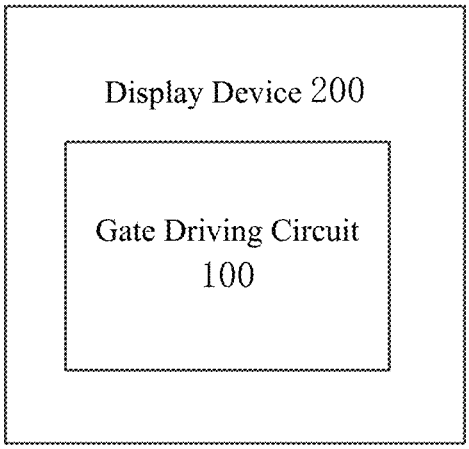
FIG. 9 is a block diagram showing a display device according to one embodiment of the present disclosure.

FIG. 9 is a block diagram showing a display device according to an embodiment of the present disclosure. As shown in FIG. 9, the display device 200 includes the gate driving circuit 100 described in the foregoing embodiments.

Figure 10:
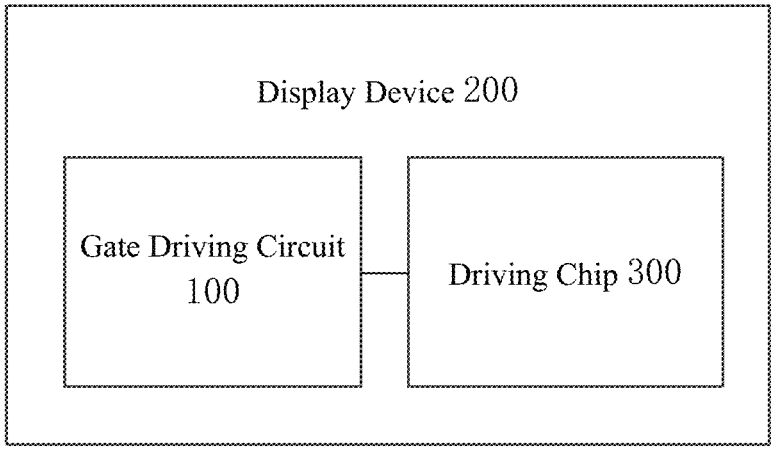
FIG. 10 is a block diagram showing a display device according to one embodiment of the present disclosure.

According to an embodiment of the present disclosure, as shown in FIG. 10, the display device 200 further includes a driving chip 300. The driving chip 300 is used to provide a driving signal for the gate driving circuit 100, and the first voltage line is not connected to the driving chip 300. Specifically, the driving signal may include a clock signal, a high level signal, and the like. More specifically, in combination with the embodiment of FIG. 3, in the pad area of the display device the low voltage signal line can be removed, and only the high voltage signal line 1 and the clock signal line 3 are arranged. Thus, the driving chip 300 can be connected to the high voltage signal line 1 and the clock signal line 3 in the pad area, and not connected to the first voltage line for providing the low voltage signal.

According to the display device of the embodiment of the present disclosure, the voltage-self-set function can be realized by the above gate driving circuit, thereby effectively reducing the number of the signal lines in the pad area of the display device, such as removing the signal line for powering the first voltage line in the pad area, reducing the wiring space of the pad area and providing a larger space available for cutting for the cut irregular-shaped screen.

In the description of the present specification, the description with reference to the terms "one embodiment", "some embodiments", "example", "specific example", "some examples" or the like means that specific features, structures, materials or characteristics described in connection with the embodiment or example are contained in at least one embodiment or examples of the present disclosure. In the present specification, the schematic representation of the above terms is not necessarily directed to the same embodiment or example. Furthermore, the specific features, structures, materials, or characteristics described may be combined in a suitable manner in any one or more embodiments or examples. In addition, various embodiments or examples described in the specification, as well as features of various embodiments or examples, may be integrated and combined without contradicting each other.

Moreover, the terms "first" and "second" are used for descriptive purposes only, and are not to be construed as indicating or implying a relative importance or implicitly indicating the number of technical features indicated. Thus, a feature defined by "first" or "second" may include at least one of the features, either explicitly or implicitly. In the description of the present disclosure, "a plurality" means that the number is at least two, such as two, three, etc., unless specifically defined otherwise.

Any process or method description in the flowcharts or otherwise described herein may be understood to represent a module, segment or portion of a code comprising one or more executable instructions for implementing a custom logic function or steps of a process. Moreover, the scope of the preferred embodiments of the present disclosure includes additional implementations in which the functions involved may be performed in an order rather than the order shown or discussed, including performing the functions in a substantially simultaneous manner or in a reverse order, which should be understood by those skilled in the art to which the embodiments of the present disclosure pertain.

The logic and/or steps represented in the flowchart or otherwise described herein may be, for example, considered as an ordered listing of executable instructions for implementing logical functions, and may be embodied in any computer-readable medium for use by or in combination with an instruction execution system, apparatus, or device, such as a computer-based system, processor-containing system, or other system that can fetch the instructions from the instruction execution system, apparatus, or device. For this specification, a "computer-readable medium" may be any apparatus that can contain, store, communicate, propagate, or transport a program for use by or in combination with an instruction execution system, apparatus, or device. More specific examples (non-exhaustive list) of the computer-readable medium include: an electrical connection (an electronic device) having one or more wires, a portable computer diskette (a magnetic device), a random access memory (RAM), a Read-only memory (ROM), an erasable programmable read only memory (EPROM or flash memory), an optical fiber device, and a portable compact disk read only memory (CDROM). In addition, the computer-readable medium may even be paper or another suitable medium on which the program can be printed, as the program can be electronically captured via, for instance, optical scanning of the paper or other medium, then compiled, interpreted or otherwise processed in a suitable manner, if necessary, and then stored in a computer memory.

It should be understood that the various portions of the present disclosure may be implemented in hardware, software, firmware or any combination thereof. In the above embodiments, a plurality of steps or methods may be implemented by software or firmware executed by appropriate instructions stored in a memory. For example, if it is realized by hardware, it may be realized by any one of the following technologies known in the art or a combination thereof as in another embodiment: a discreet logic circuit having logic gates for implementing logic functions upon data signals, an application specific integrated circuit having appropriate combinational logic gates, a programmable gate array (PGA), a field programmable gate array (FPGA), etc.

One having ordinary skills in the art can understand that all or part of the steps included in the method of implementing the above embodiments can be completed by means of relevant hardware that is instructed by a program, and the program can be stored in a computer-readable storage medium, and comprises any one or combination of the steps in the method embodiment when being executed.

In addition, various functional units in various embodiments of the present disclosure may be integrated into one processing module, or may exist physically separately, or two or more of the units may be integrated into one module. The above integrated modules can be implemented in the form of hardware or in the form of software functional modules. The integrated modules, if implemented in the form of software functional modules and sold or used as separate products, may also be stored in a computer-readable storage medium.

The storage medium mentioned above may be a read only memory, a magnetic disk, an optical disk or the like. While the embodiments of the present disclosure have been shown and described above, it is understood that the above-described embodiments are illustrative and are not to be construed as limiting the present disclosure, and a person having ordinary skills in the art can make changes, modifications, substitutions and variations to the above embodiments.

What is claimed is:

1. A gate driving circuit, comprising:

N-stage gate driving units, the gate driving unit at each stage of the N-stage gate driving units having a first voltage terminal and a clock signal terminal, and a first transmission path being formed between the first voltage terminal and the clock signal terminal, wherein N is an integer greater than 1, and at each stage, the first transmission path of the gate driving unit is conductive when the gate driving unit is in a non-operative state; and a first voltage line connected to the first voltage terminal of the gate driving unit at each stage, wherein a preset voltage received by the clock signal terminal of the gate driving unit that is in a non-operative state is transmitted to the first voltage line through the first transmission path of the gate driving unit, so that the first voltage line provides the preset voltage for the first voltage terminal of the gate driving unit at each stage, wherein the gate driving unit at each stage comprises an output unit, an input unit and a first pull-down unit, in the gate driving unit at each stage, the first transmission path is formed by the output unit and the first pull-down unit, the output unit is connected to the clock signal terminal, the input unit of the gate driving unit and an output terminal of the gate driving unit, the first pull-down unit is connected to the first voltage terminal and the output terminal of the gate driving unit, and the gate driving unit at each stage comprises a reset unit and a second pull-down unit, wherein in the gate driving unit at each stage, the second transmission path is formed by the reset unit and the second pull-down unit, the reset unit is connected to the second voltage terminal, the output unit, the input unit of the gate driving unit and the second pull-down unit, and the second pull-down unit is connected to the first voltage terminal and the reset unit.

2. The gate driving circuit according to claim 1, wherein the gate driving unit at each stage of the N-stage gate driving units further has a second voltage terminal, and a second transmission path is formed between the first voltage terminal and the second voltage terminal, wherein at each stage, the second transmission path of the gate driving unit is conductive when the gate driving unit is in the non-operative state;

the gate driving circuit further comprises a second voltage line connected to the second voltage terminal of the gate driving unit at each stage; and the preset voltage of the first voltage line is transmitted to the second voltage line through the second transmission path of the gate driving unit that is in the non-operative state, so that the second voltage line provides the preset voltage for the second voltage terminal of the gate driving unit at each stage.

3. The gate driving circuit according to claim 1, wherein in the gate driving unit at each stage, the first pull-down unit and the second pull-down unit are also connected to a control unit of the gate driving unit, and the first pull-down unit and the second pull-down unit are turned on under the control of the control unit so that the first transmission path and the second transmission path are conductive.

4. The gate driving circuit according to claim 3, wherein in the gate driving unit at each stage, the output unit comprises:

a first transistor having a gate electrode connected to the input unit of the gate driving unit, a first electrode connected to the clock signal terminal, and a second electrode connected to the output terminal of the gate driving unit; and a first capacitor having one end connected to the gate electrode of the first transistor and another end connected to the second electrode of the first transistor.

5. The gate driving circuit according to claim 4, wherein the preset voltage is a low voltage signal when the first transistor is an N-type transistor.

6. The gate driving circuit according to claim 5, wherein the low voltage signal is set to −12 V.

7. The gate driving circuit according to claim 4, wherein the present voltage is a high voltage signal when the first transistor is a P-type transistor.

8. The gate driving circuit according to claim 7, wherein the high voltage signal is set to +12 V.

9. The gate driving circuit according to claim 7, wherein at each stage, the gate driving unit further comprises a third pull-down unit connected to the first voltage terminal and the output terminal.

10. The gate driving circuit according to claim 9, wherein in the gate driving unit at each stage, the third pull-down unit comprises a tenth transistor having a gate electrode connected to a control signal terminal, a first electrode connected to the output terminal of the gate driving unit, and a second electrode connected to the first voltage terminal.

11. The gate driving circuit according to claim 3, wherein in the gate driving unit at each stage, the first pull-down unit comprises:

a second transistor having a gate electrode connected to the control unit, a first electrode connected to the output terminal of the gate driving unit, and a second electrode connected to the first voltage terminal.

12. The gate driving circuit according to claim 3, wherein in the gate driving unit at each stage, the second pull-down unit comprises:

a third transistor having a gate electrode connected to the control unit, a first electrode connected to the reset unit, and a second electrode connected to the first voltage terminal.

13. The gate driving circuit according to claim 3, wherein in the gate driving unit at each stage, the reset unit comprises:

a fourth transistor having a gate electrode connected to a reset terminal of the gate driving unit, a first electrode connected to the input unit, the output unit and the second pull-down unit, and a second electrode connected to the second voltage terminal.

14. The gate driving circuit according to claim 3, wherein in the gate driving unit at each stage, the control unit comprises:

a fifth transistor having a gate electrode connected to a first electrode of the fifth transistor and further to a third voltage terminal;

a sixth transistor having a first electrode connected to a second electrode of the fifth transistor, a second electrode connected to the first voltage terminal, and a gate electrode connected to the input unit and the output unit;

a seventh transistor having a gate electrode connected to the second electrode of the fifth transistor and a first electrode connected to the third voltage terminal; and an eighth transistor having a first electrode connected to a second electrode of the seventh transistor and further to the first pull-down unit and the second pull-down unit, a second electrode connected to the first voltage terminal, and a gate electrode connected to the input unit and the output unit.

15. The gate driving circuit according to claim 1, wherein the gate driving circuit is a gate driver on array (GOA) circuit.

16. A display device, comprising a gate driving circuit that comprises:

N-stage gate driving units, the gate driving unit at each stage of the N-stage gate driving units having a first voltage terminal and a clock signal terminal, and a first transmission path being formed between the first voltage terminal and the clock signal terminal, wherein N is an integer greater than 1, and at each stage, the first transmission path of the gate driving unit is conductive when the gate driving unit is in a non-operative state; and a first voltage line connected to the first voltage terminal of the gate driving unit at each stage, wherein a preset voltage received by the clock signal terminal of the gate driving unit that is in a non-operative state is transmitted to the first voltage line through the first transmission path of the gate driving unit, so that the first voltage line provides the preset voltage for the first voltage terminal of the gate driving unit at each stage, wherein the gate driving unit at each stage comprises an output unit, an input unit and a first pull-down unit, in the gate driving unit at each stage, the first transmission path is formed by the output unit and the first pull-down unit, the output unit is connected to the clock signal terminal, the input unit of the gate driving unit and an output terminal of the gate driving unit, the first pull-down unit is connected to the first voltage terminal and the output terminal of the gate driving unit, and the gate driving unit at each stage comprises a reset unit and a second pull-down unit, wherein in the gate driving unit at each stage, the second transmission path is formed by the reset unit and the second pull-down unit, the reset unit is connected to the second voltage terminal, the output unit, the input unit of the gate driving unit and the second pull-down unit, and the second pull-down unit is connected to the first voltage terminal and the reset unit.

17. The display device according to claim 16, wherein the display device further comprises a driving chip that is configured to provide a driving signal for the gate driving circuit, and the first voltage line is not connected to the driving chip.

* * * * *